US005526836A

United States Patent [19]

Sigsworth

[11] Patent Number: 5,526,836

[45] Date of Patent: Jun. 18, 1996

[54] CRUTCH CARRYING BAG

[76] Inventor: Joanne D. Sigsworth, 4713 Dreyfous Ave., Metairie, La. 70006

[21] Appl. No.: 539,592

[22] Filed: Oct. 5, 1995

[51] Int. Cl.[6] ..... A45B 3/00

[52] U.S. Cl. ..... 135/66; 135/68; 150/107

[58] Field of Search ..... 135/66, 68, 72, 135/76; 150/100, 106, 107, 109, 124, 114

[56] References Cited

U.S. PATENT DOCUMENTS

| | | | |
|---|---|---|---|
| 501,728 | 7/1893 | Nathan | 150/114 X |
| 2,116,869 | 5/1938 | Lewis | 150/106 |
| 2,210,493 | 8/1940 | Lisi | 135/66 |
| 2,529,724 | 11/1950 | Conwiser | 150/114 X |
| 3,347,299 | 10/1967 | Alexander | 150/106 X |
| 4,027,687 | 6/1977 | McGowan | 135/66 |
| 4,074,740 | 2/1978 | Anderson | 150/106 |
| 4,289,156 | 9/1981 | Ulics | 135/66 |
| 4,850,383 | 7/1989 | McBride | 135/66 |
| 4,946,058 | 8/1990 | Stamm | 135/66 X |
| 5,101,845 | 4/1992 | Kravetz | 135/66 |
| 5,101,846 | 4/1992 | Greatwood | 135/73 |
| 5,285,833 | 2/1994 | Haxby | 150/107 X |
| 5,415,332 | 5/1995 | Kliot | 150/106 X |

*Primary Examiner*—Lanna Mai
*Attorney, Agent, or Firm*—Joseph N. Breaux

[57] ABSTRACT

A crutch carrying bag including a bag member including a user securable flap; and a strap assembly including two elongated strap members. Each strap member has a snap latch fastener secured to one end thereof and an O-ring connector securing a second end thereof to the bag member. The two snap latch/O-ring pairs are engageable to form a pair of closed loops that are connected about the hand grip of a crutch to secure the bag member to the crutch during use. The exterior of the securable flap preferably includes a beeper clip slot sized to receive therein the clip of a beeper.

4 Claims, 3 Drawing Sheets

CRUTCH CARRYING BAG

TECHNICAL FIELD

The present invention relates to carrying bags utilized to store and carry a variety of articles and more particularly to carrying bags utilized to store and carry a variety of articles that include a pair of connecting mechanisms for securing the carrying bag to the hand grip of a crutch.

BACKGROUND ART

Individuals having injured legs often require crutches to move from place to place. Conventional crutches include an adjustable length support portion, an underarm support member and a hand grip. In use, the user positions the under arm support members into the armpits and holds the crutches in place by grasping the hand grips with the hands. Because the hands are thus occupied, it can be difficult for individuals requiring the assistance of crutches to carry and transport various items from place to place. It would be a benefit, therefore, to have a carrying bag that was securable to a crutch that allowed a variety of items to be stored and transported. To provide security from theft, it would be a further benefit if the carrying bag required the removal of two separate connecting mechanisms. It would also be desirable if the carrying bag were detachable from the carrying bag and useable without the crutch.

GENERAL SUMMARY DISCUSSION OF INVENTION

It is thus an object of the invention to provide a crutch carrying bag that is securable to a crutch allowing a variety of items to be stored and transported.

It is a further object to provide a crutch carrying bag that requires the removal of two separate connecting mechanisms before the carrying bag is disconnected from the crutch handle.

It is a still further object of the invention to provide a crutch carrying bag that is detachable from the carrying bag and useable without the crutch.

It is a still further object of the invention to provide a crutch carrying bag that accomplishes all or some of the above objects in combination.

Accordingly, a crutch carrying bag is provided. The crutch carrying bag includes a bag member including a user securable flap; and a strap assembly including two elongated strap members. Each strap member has a snap latch fastener secured to one end thereof and an O-ring connector securing a second end thereof to the bag member. The two snap latch/O-ring pairs are engageable to form a pair of closed loops that are connected about the hand grip of a crutch to secure the bag member to the crutch during use. The exterior of the securable flap includes a beeper clip slot sized to receive therein the clip of a beeper.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
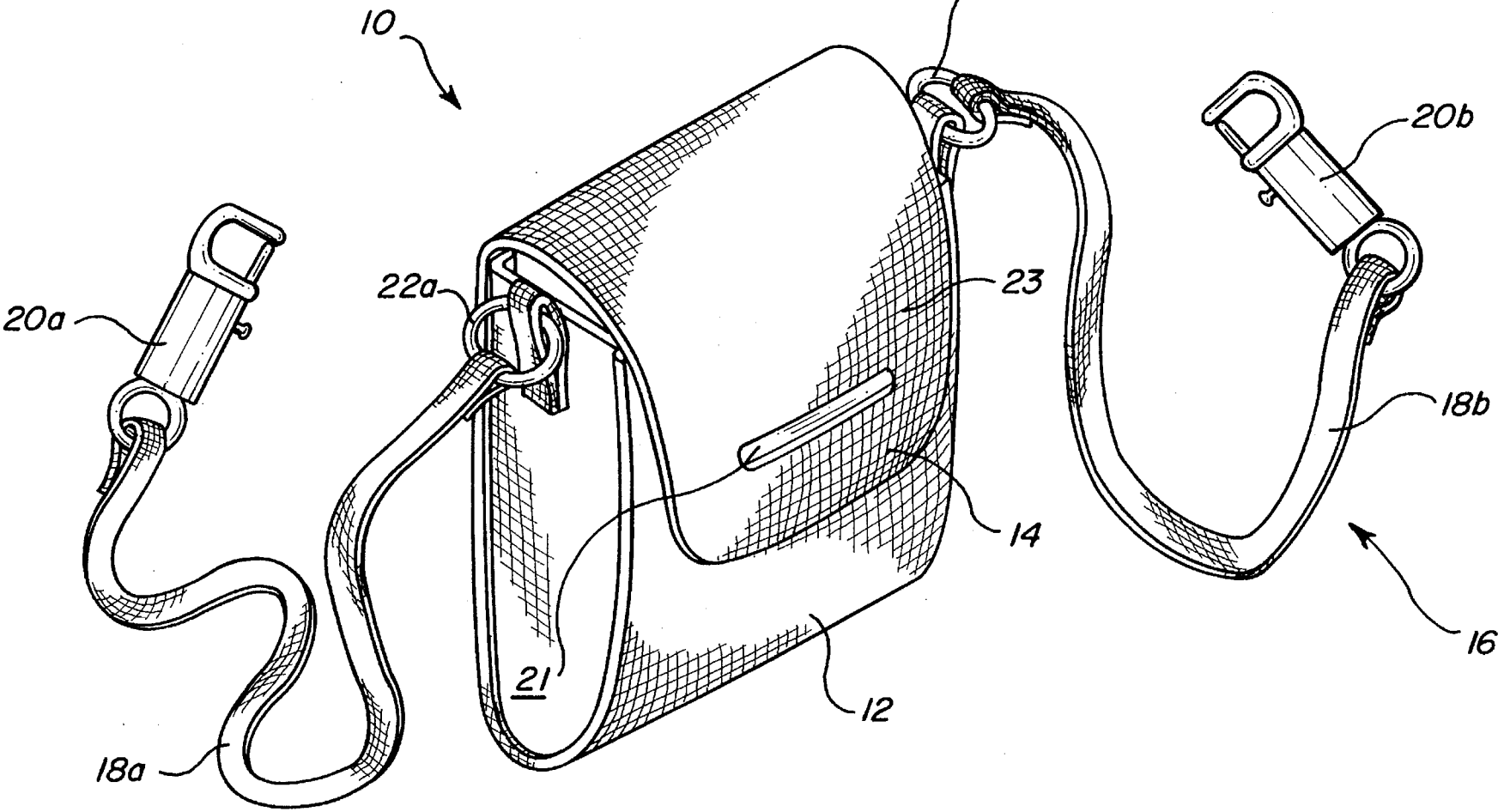
FIG. 1 is a perspective view of an exemplary embodiment of the crutch carrying bag of the invention with the securable flap in the secured configuration.

FIG. 1 shows an exemplary embodiment of the crutch carrying bag of the present invention generally referenced by the numeral 10. Crutch carrying bag 10 includes a bag member 12 including a user securable flap 14; and a strap assembly, generally designated by the numeral 16, including two elongated strap members 18*a*,18*b*. Each strap member 18*a*,18*b* has a snap latch fastener 20*a*,20*b* secured to one end thereof and an O-ring connector 22*a*,22*b* securing a second end thereof to bag member 12. Also show in the figure is a beeper clip slot 21 formed through an exterior surface 23 of flap member 14.

Figure 2:
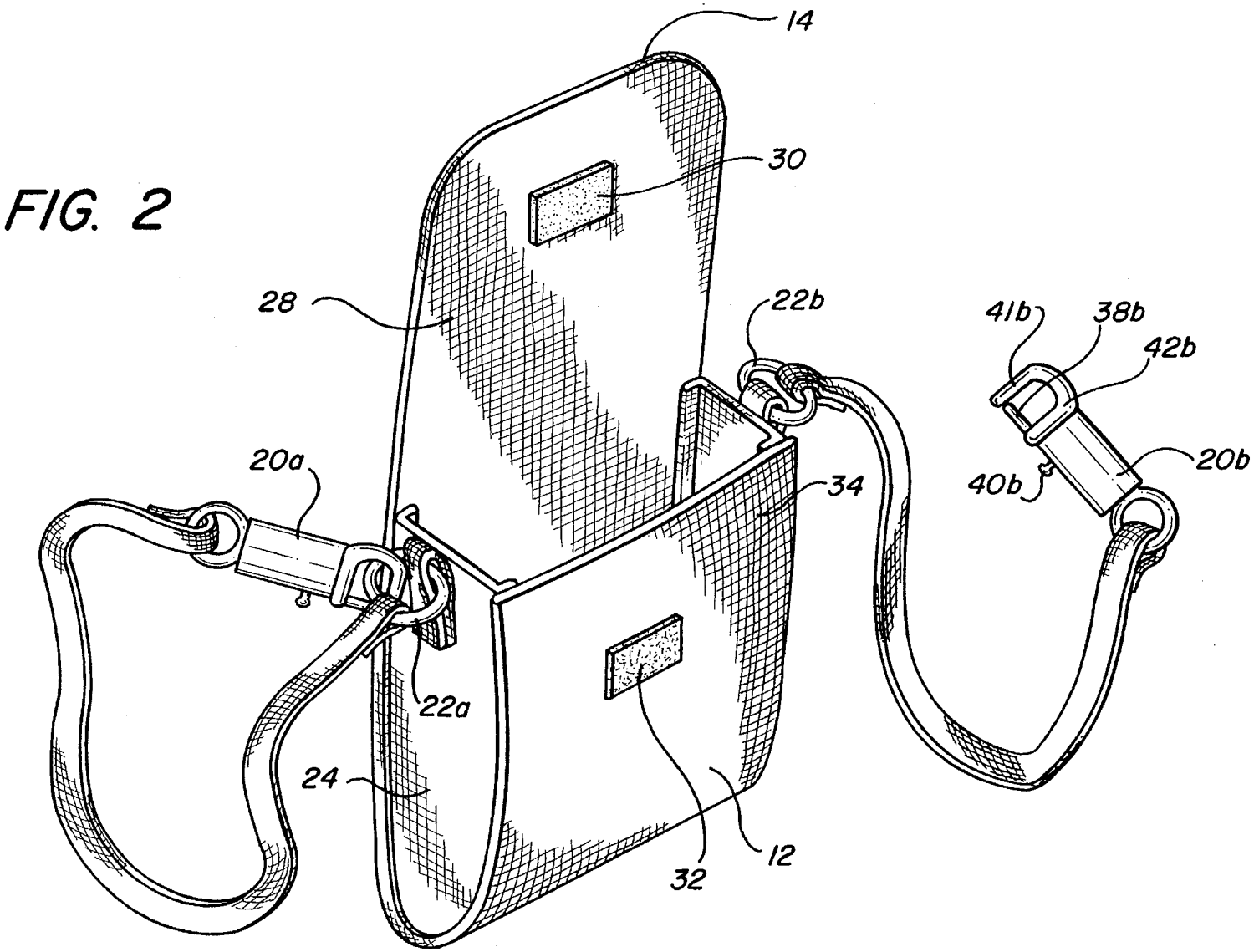
FIG. 2 is a perspective view of the crutch carrying bag of FIG. 1 showing the securable flap in the unsecured configuration.

With reference to FIG. 2, Bag member 12 includes a bag portion 24 that defines a storage compartment 26. The interior surface 28 of flap member 14 includes a first section 30 of hook and pile type fastener that engages a second section 32 of hook and pile fastener disposed on an exterior surface 34 of bag portion 24.

Also shown in the figure is snap latch fastener 20*a* secured to O-ring connector 22*a* thus forming a first closed loop that, in use, is secured about a crutch handle of a crutch. Snap latch fastener 20*b* is similarly securable to O-ring connector 22*b* to form a second closed loop. The connection between O-ring 22*b* and snap latch fastener 20*b* is formed by retracting spring biased, snap latch bar 38*b* with a thumb knob 40*b*; inserting the forward leg 41*b* of U-shaped latch portion 42*b* through O-ring connector 22*b*; and, then, releasing thumb knob 42*b* allowing latch bar 38*b* to rebound to a position blocking passage of O-ring 22*b* between the legs of U-shaped latch portion 42*b*.

Figure 3:
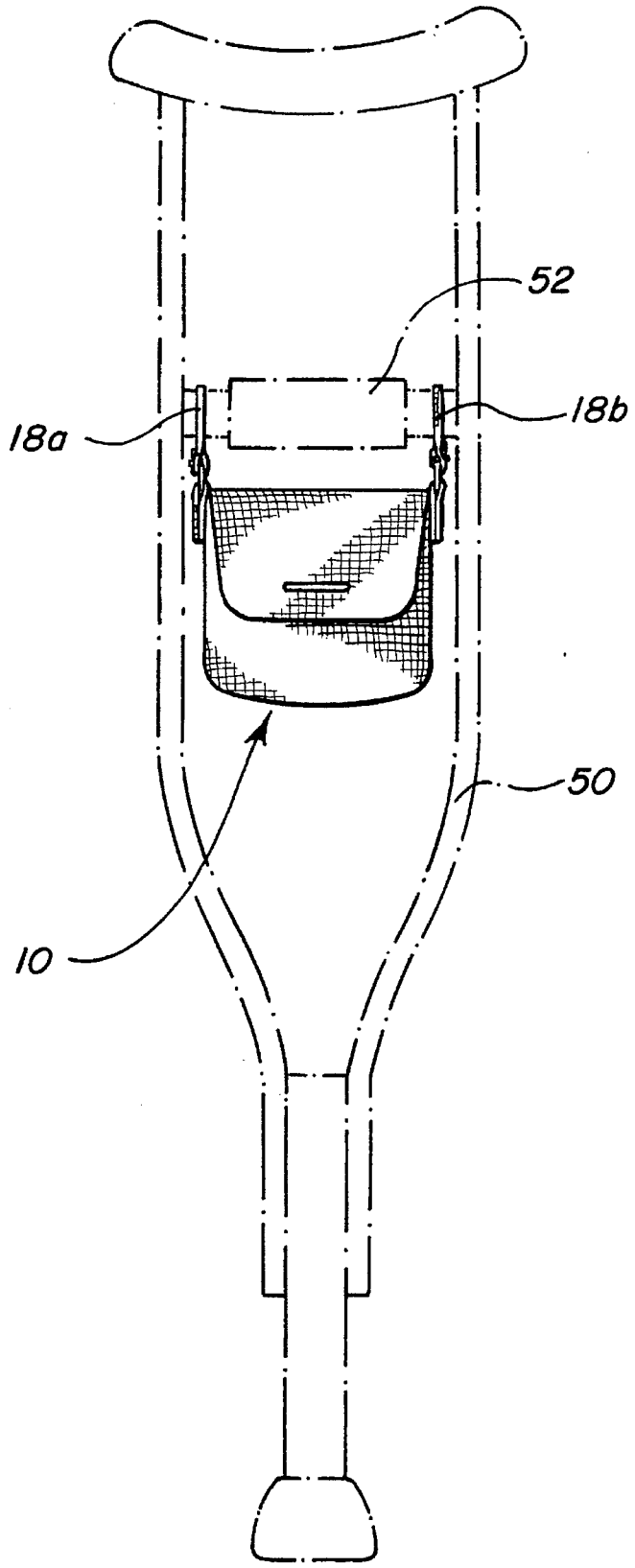
FIG. 3 is a side view showing the exemplary crutch carrying bag of FIG. 1 secured to the hand grip of a representative crutch.

FIG. 3 shows carrying bag 10 in use with a representative crutch 50. As shown in the figure, strap members 18*a*,18*b* are configured in the closed loop configuration about to padded crutch hand grip 52.

Use of crutch carrying bag 10 is now described with general reference to FIGS. 1–3. Carrying bag 10 is secured to crutch hand grip 52 by forming strap members 18*a*,18*b* into the closed loop configuration with crutch hand grip 52 within the closed loops. Once these loops are formed, carrying bag 10 is secured with two distinct securing mechanisms to crutch 50. This provides a dual securing mechanism for preventing theft or loss of carrying bag 10. If desired, carrying bag 10 may be configured in a crutch less carrying configuration by fastening snap latch fastener 20*a* to O-ring connector 22*b* and snap latch fastener 20*b* to O-ring connector 22*a*.

It can be seen from the preceding description that a crutch carrying bag has been provided that is securable to a crutch; that requires the removal of two separate connecting mechanisms before the carrying bag is disconnected from the crutch handle, and that is detachable from the carrying bag and useable without the crutch.

It is noted that the embodiment of the crutch carrying bag described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A crutch carrying bag comprising:

a bag member; and a strap assembly; said bag member including a bag portion that defines a storage compartment and a securable flap member having a first section of hook and pile type fastener that engages a second section of hook and pile fastener disposed on an exterior surface of said bag portion; said strap assembly including a first strap member and a second strap member, each said strap member having a snap latch fastener secured to one end thereof and an O-ring connector securing a second end thereof to said bag member, said two snap latch/O-ring pairs being engageable to form a pair of closed loops about a hand grip of a crutch to secure said bag member to said crutch during use.

2. The crutch carrying bag of claim 1, wherein:

said snap latch fasteners include a spring biased snap latch bar having a thumb knob and a U-shaped latch portion having first and second leg portions spaced sufficiently to allow a section of said O-ring connector to pass therebetween.

3. The crutch carrying bag of claim 1, wherein:

a beeper clip slot is formed through an exterior surface of said flap member.

4. The crutch carrying bag of claim 3 wherein:

said snap latch fasteners include a spring biased snap latch bar having a thumb knob and a U-shaped latch portion having first and second leg portions spaced sufficiently to allow a section of said O-ring connector to pass therebetween.

* * * * *